United States Patent [19]

Utterback et al.

[11] Patent Number: 4,928,910

[45] Date of Patent: May 29, 1990

[54] DETECTION OF OVERHEATED RAILROAD WHEEL AND AXLE COMPONENTS

[75] Inventors: Jeffery J. Utterback, Harrisonville; Randall S. Mecca, Warrensburg, both of Mo.

[73] Assignee: Harmon Industries, Inc., Blue Springs, Mo.

[21] Appl. No.: 255,787

[22] Filed: Oct. 11, 1988

[51] Int. Cl.[5] ..... B61K 9/06

[52] U.S. Cl. ..... 246/169 A; 250/342; 340/682; 340/600; 340/584

[58] Field of Search ..... 246/169 A, 169 D; 250/338.3, 340, 341, 342; 340/682, 600, 584

[56] References Cited

U.S. PATENT DOCUMENTS

| | | | |
|---|---|---|---|
| 3,303,340 | 2/1967 | Hewett et al. | 246/169 D |
| 3,545,005 | 12/1970 | Gallagher | 246/169 A |
| 3,733,499 | 5/1973 | Deis et al. | 250/338.3 |
| 4,068,811 | 1/1978 | Caulier | 246/169 A |
| 4,765,413 | 8/1988 | Spector et al. | 250/342 |
| 4,813,003 | 3/1989 | Cox et al. | 250/338.3 |

*Primary Examiner*—Andres Kashnikow
*Assistant Examiner*—Mark T. Le
*Attorney, Agent, or Firm*—D. A. N. Chase; Joan Optican Herman

[57] ABSTRACT

Overheated railroad journal bearings, wheels, and wheel components on a moving or stationary railroad train are detected by amplifying the current signal from an infrared radiation sensor comprising a pyroelectric cell. A reference temperature is sensed by chopping the incident infrared radiation with an asynchronous shutter that momentarily closes at successive time spacings of shorter duration than the scanning period of the sensor. The amplified signal is converted to a digital signal and processed by a microcontroller and associated hardware and software. The software comprises a free-running loop Main Program which is subject to several interrupts. The output signal may be digital or analog and is transmitted to remote signal processing equipment for further processing.

18 Claims, 9 Drawing Sheets

10 MHZ
-34-
RAM
ROM
ROM
LATCH
-24-
CPU
CNTL
DGC
-52-

+5V
-5V
+5V
-5V

DETECTION OF OVERHEATED RAILROAD WHEEL AND AXLE COMPONENTS

BACKGROUND OF THE INVENTION

1. Field of the Invention

The present invention is directed to a method and apparatus for detecting overheated wheel and axle components on railroad cars. More particularly, the present invention is directed to an infrared scanning circuit that employs analog and digital microelectronic circuitry in processing the infrared emitted from such components to determine, in conjunction with ancillary circuitry, whether any individual component is overheated, and, if so, to produce a warning signal that may be transmitted to any of a number of warning read-out devices.

2. The Prior Art

Modern railroad car wheel bearings are permanently lubricated sealed units designed to last for the life of the car. Sometimes, however, these wheel bearings fail during use, causing excess friction between the axle and the bearing and producing excess heat, resulting in a condition referred to as a hot box. Normally, the bearings operate at about 20 degrees centigrade (C) above the ambient temperature. When a bearing begins running at more than about 70 degrees C. above the ambient temperature, it has already failed. If the car continues moving at the same speed, internal fracture of a roller bearing can cause the bearing to seize, creating thermal run-away. In thermal run-away the bearing temperature rises dramatically from about 20 degrees C. above the ambient temperature to more than 300 degrees C. above the ambient temperature in about one-half mile of travel; under further travel the bearing melts and falls off the axle; the wheels fall off; and the truck falls to the ground, uncoupling the car from those in front of it, triggering the emergency brakes on the whole train and causing the portion of the train behind the disabled car to collapse into an accordion-patterned wreck as the cars leave the tracks.

Brakes that fail to release also produce a dangerous condition that can cause a similar disaster. The affected wheel rises to temperatures on the order of 600 degrees C and creates a condition known as a hot wheel. If unchecked, the wheel ultimately disintegrates and a derailment results.

Because the hot box and the hot wheel can be so dangerous, the railroad service industry has devoted significant resources to building detectors that automatically check passing trains for hot boxes and/or hot wheels. Such detectors are conventionally spaced along railroad tracks at about twenty to fifty mile intervals along main-line track throughout the United States, and many are necessarily located in remote places. In addition, detectors are continually exposed to and must operate in extremes of heat and cold, wind and rain, and vigorous vibration. Naturally the railroad industry needs highly reliable, low maintenance hot box and hot wheel detectors, preferably at reasonable cost. Although previous efforts have produced several sound products, a number of important problems have not been solved in the prior art.

Detectors in present use typically include a sensing unit lens for focusing infrared from passing wheels onto an infrared sensor and electrical circuitry to develop a signal that is representative of the journal or wheel temperature. One sensing unit is placed along one rail of the tracks and a second sensing unit is placed along the other rail of a set of tracks, so that both sides of a train can be monitored. Electrical lines connect these track-side sensing units to processing circuitry which is conventionally located in a "bungalow" close to the tracks. The final output signal of the detector can be used to create a written record of the temperature of each of the journals or wheels that passes the sensing units. In hot box detectors this signal triggers a warning output if the signal indicates that the temperature of a wheel journal exceeds a predetermined value (generally about 70 degrees C. above the ambient temperature), i.e., if a hot box is detected. The warning output can be used to stimulate any convenient type of warning device. For example, the warning can be displayed on a light board in the cab of the locomotive or in a dispatcher's office, or it can cause a stop signal to be displayed on traffic signals along the tracks.

The prior art includes the commonly used bolometer type of hot box and hot wheel detector. It employs temperature sensitive resistors (thermistors) in a bridge arrangement. Such units also require a highly stable and accurate high voltage supply. Because the signal-to-noise ratio of the bolometer decreases to unacceptable levels even within the normal operating temperature ranges of the detectors, automatic heaters must be installed to keep the thermistors warm enough to work properly. Once heaters are installed, it may become necessary to upgrade the optical system of the bolometer. Thus, overcoming the fundamental problems inherent in a bolometer greatly complicates the device, making it more expensive to build and maintain, and less reliable. In addition, the frequency response of the bolometer is narrower than desired, restricting the top speed a train may be traveling while the bolometer checks for hot boxes or wheels. For a more detailed examination of the shortcomings of bolometers, see U.S. Pat. No. 4,068,811, entitled "Hotbox Detector," issued Jan. 17, 1978.

In an effort to overcome these and other problems, pyroelectric cells were introduced for use as the infrared detection element in hot box and hot wheel detectors. Pyroelectric crystals acquire opposite electrical charges on opposite faces when subjected to a change in temperature. Pyroelectrical cells are also exhibit some piezoelectrical properties, but the incidence of spurious signals generated by vibration have been virtually eliminated through physically isolating the cell from vibration. Pyroelectrical cells overcome many of the difficulties associated with bolometers. For example, hot box detectors built around pyroelectric detection schemes cost only about one-fifth to one-half as much as bolometers. Because the pyroelectric cell generates its own electrical charge, large power supplies are not needed and the high impedance obviates the careful impedance matching of the bolometer. Further, no heaters are required because the signal-to-noise ratio is substantially flat over the required temperature range. Accordingly, simpler and cheaper optical systems can be used. Nevertheless, use of pyroelectric cells confronts the designer with other serious difficulties.

For example, pyroelectric cells tend to have an extremely poor voltage gain response when considered over any reasonable range of signal input frequencies, that is, over a range of train speeds. The voltage gain response tends to depend on the length of time that the pyroelectric cell is exposed to the infrared, as well as the strength of the infrared. Thus, a typical infrared sensor employing a pyroelectric cell has an acceptably flat or constant voltage gain response over only about two percent of the frequency range required for acceptable hot detector operation, which is about 0.5 Hz to about 300 Hz. This prevents accurate temperature readings when a linear amplifier is used, yet only the voltage gain has a sufficiently high signal-to-noise ratio to provide a usable signal.

One prior art approach to overcoming this difficulty is to add a compensating signal to the pyroelectric cell signal to produce a signal having a flat frequency response over the normal range of frequencies, as set forth in the aforementioned U.S. Pat. No. 4,068,811. Over time, however, the breakpoint at which the voltage response of the pyroelectric cell begins to decline sharply drifts unpredictably due to changes in capacitance and response time. It may drift up or down the frequency scale; it may drift by different amounts. Neither the magnitude nor the direction of the drift will be the same for different detectors. The circuitry that develops the compensating signal cannot compensate for this drift, and so the detector will not produce the flat voltage response over the relevant frequency range that the remaining circuitry must have for proper operation. This long term signal drift requires frequent calibration checks of the pyroelectric cell. Such checks, and if necessary, re-calibration, are extremely difficult to perform accurately in the field and often require taking the unit to the shop. Even with frequent servicing, such units are often out of calibration and the resulting calibration errors lead to further reporting errors and increased service costs.

Another difficulty is created by the physical characteristics of pyroelectric crystals—namely that they produce an electrical potential only in response to changes in temperature. This characteristic requires that the infrared detector, that is, the pyroelectric cell, be subjected to changes in the amount of infrared striking it. In addition, the normal operating temperature of a railroad wheel bearing is determined relative to the ambient temperature. The requirement of measuring both the wheel bearing temperature and the ambient temperature provides a ready made opportunity to expose the pyroelectric cell to the required changes in infrared. Difficulties arise, however, in choosing a suitable infrared source to determine the ambient temperature.

Some pyroelectic hot box detectors in the prior art approach this problem by merely leaving the detector turned on whenever a train is passing and aiming the lens so that it receives infrared from passing bearings, and from the undercarriage of the railroad cars. This passive-read system assumes that the temperature reading developed from looking at the undercarriage is the ambient temperature, and compares this to the temperature of the bearing. This solution works well if the undercarriage is actually at ambient temperature, but if, for example, the undercarriage is on fire (which not infrequently occurs from faulty brakes), such a detector will see the heat from the fire as the ambient temperature and will be unable to detect any problem with a bearing, or even to detect the fire itself. Less dramatically, the sensor may measure the heat from a spurious source, such as brakes, and, unable to distinguish between hot brakes and hot bearings, issue a hot box warning. Then the crew must stop the train, and walk the train searching for a non-existent over-heated bearing.

Another problem for passive-read systems is presented by the increased used of railroad spine cars, which are a skeleton steel-rail flatbed with trucks attached. Spine cars are used to haul semi-trailers piggyback. When a passive-read hot box detector looks at the undercarriage of spine cars, it is likely to take a "sky shot," and read only infrared from the distant sky as ambient. A sky shot temperature reading is usually about 20 degrees C. to 30 degrees C. less than actual ambient temperature. Naturally, this leads to many false warnings, since a bearing at normal operating temperature would show up as 40 degrees C. to 50 degrees C. hotter than the ambient temperature. Again, the crew must stop the train and walk the train searching for a non-existent hot box.

One prior art approach to overcoming this difficulty is to include a shutter that covers the lens at all times except when the apparatus expects to see a wheel bearing. This practice screens out all spurious infrared from overheated brakes and the like, and takes for its ambient temperature reading the temperature of the shutter blade inside the detector housing. The detector, however, warms up and cools down more slowly than the true ambient temperature, especially during periods of rapid ambient temperature changes. These changes predictably occur around sunrise and sunset, and unpredictably occur during weather changes and in magnitudes that depend on the season and the weather. The temperature inside the detector housing tends to lag the actual ambient temperature by about two hours. This temperature lag can cause the measured difference between the correct ambient temperature and the journal bearing temperature to be wrong by as much as 10 degrees C. In addition, sun loading can heat the detector unit to a temperature that is considerably hotter than the ambient temperature. These differences between internal detector temperature and the actual ambient temperature can obviously lead to erroneous comparisons between ambient temperature and bearing temperature, creating both false negatives and false positives.

In addition, the prior art shutter detection scheme requires synchronization between the opening and closing of the shutter and the passing of the bearings, which necessitates rapidly starting and stopping the shutter. The shutter is operated by an electric solenoid. The ancillary devices required to synchronize the movement of the shutter with the passing train wheels are complex and expensive. Repeatedly energizing the shutter solenoid wears out the solenoid quickly, and the jolt caused by stopping the shutter sometimes creates spurious signals from the pyroelectric cell due to its piezoelectric characteristics. Accordingly, although use of a synchronized shutter to screen unwanted infrared from the pyroelectric cell avoids the temperature sensing problems of the passive-read system, it leads to complex problems of its own.

Furthermore, prior art hot box and hot wheel detectors transmit an analog output signal. Analog signals are naturally more prone to degradation, distortion, and attenuation than digital signals, and typically can carry far less information. Increasingly, remote signalling devices and other ancillary equipment accept digital signals, which not only may convey more information, but do so more accurately than analog signals.

Therefore, a need exists for hot box and hot wheel detectors that are less expensive to manufacture, maintain, and operate; that are more reliable; that reduce or eliminate false negative warnings and false positive warnings, both of which are inordinately expensive; that produce consistent operating results over time by eliminating the effect of pyroelectric cell drift; and that can generate either a digital or analog output signal, allowing the user railroad to use analog ancillary devices for their full useful life if desired and then conveniently change to more modern digital ancillary device.

SUMMARY OF THE INVENTION

Accordingly, it is an object of the present invention to provide a detector for hot box or hot wheel applications that is less expensive to manufacture, maintain, and operate.

It is another object of the present invention to provide an infrared scanning circuit which uses an asynchronous shutter that rotates continuously when a train is present, eliminating the need to synchronize the shutter with the passing train wheels and reducing excessive wear on the shutter motor.

It is another object of the present invention to provide an infrared scanning circuit that uses a pyroelectric cell for detection of infrared, but measures current responsivity to thereby utilize a signal that is essentially the same for a bearing or wheel of a given temperature regardless of the speed of the train.

It is another object of the present invention to provide an infrared scanning circuit that generates either a digital or analog final output signal.

It is another object of the present invention to provide an infrared scanning circuit that is more reliable.

It is another object of the present invention to provide an infrared scanning circuit that reduces or eliminates false negative warnings and false positive warnings.

It is another object of the present invention to provide an infrared scanning circuit that reliably measures a reference ambient temperature notwithstanding non-ambient undercarriage temperatures.

It is another object of the present invention to provide an infrared scanning circuit that can determine the temperature of a journal bearing or a hot wheel regardless of the speed of the train.

These and other objects are achieved by providing an infrared scanning circuit comprising a lens that focuses incident infrared onto a pyroelectric cell, which is electrically connected to a current driver: preamplifier (preamp) that further develops the signal generated by the pyroelectric cell in response to temperature changes induced by changing amounts of infrared striking it. The infrared scanning circuit includes an asynchronous rotating shutter that screens the pyroelectric cell from extraneous infrared to provide a reference ambient temperature reading, but is not synchronized with the passage of the train wheels in front of the lens. Use of the asychronous rotating shutter allows the infrared scanning circuit to effectively monitor bearing or wheel temperature even when the train is moving slowly or is stationary.

The analog preamp output signal drives a digital gain control which outputs a signal to a microprocessor or microcontroller, as the designer may select, and all further signal processing is digital until the final output, which may be either digital or analog as the end user chooses. The infrared scanning circuit for a hot box or hot wheel detector includes suitable circuitry and computer software and firmware for automatically and frequently checking the integrity of the circuitry and software.

The achievement of these and other objects of the invention will become apparent upon consideration of the detailed description of a preferred embodiment, taken in conjunction with the drawings.

DETAILED DESCRIPTION OF THE PREFERRED EMBODIMENT

This description generally will first discuss the schematic flow of information in the system, then the asynchronous shutter, then the preamplifier and the signals it generates, then the mechanical characteristics of the apparatus, and finally, the computer programs, or software, that operate the system.

THE SCHEMATIC OF THE SYSTEM

Figure 1:
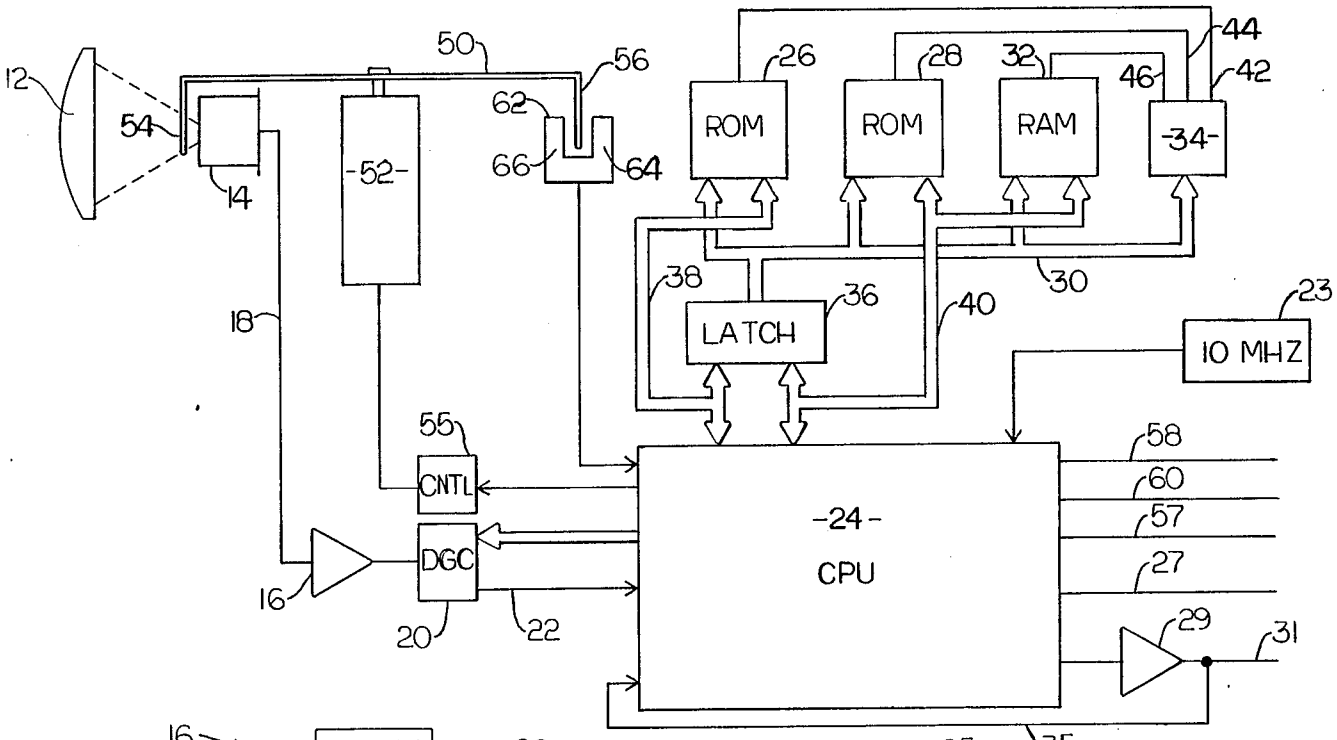
FIG. 1 is a schematic of an infrared scanning circuit according to the present invention, illustrating the mechanical elements diagramatically together with a block diagram of the electrical elements of the invention.

Referring to FIG. 1, there is shown generally an apparatus for detecting overheated railroad journal bearings, or detector 10, having a lens 12 for focusing impinging infrared onto pyroelectric cell 14. Lens 12 is conventionally a germanium lens that focuses and transmits only the far infrared portion of the spectrum. Pyroelectric cell 14, conventionally made from $LiTaO_3$, converts the impinging infrared to an analog electrical current having a magnitude that is directly proportional to the temperature of the object emitting the infrared radiation.

Preamplifier 16 amplifies the current component of the signal transmitted on line 18, thereby measuring the current response of pyroelectric cell 14 to changes in the amount of infrared striking it. Preamplifier 16 also changes the analog current signal from pyroelectric cell 14 to an analog voltage output signal. The output signal of preamplifier 16 exhibits a linear response to frequencies from 0.06 Hz to 200 Hz, where "frequency," when discussing the responsiveness of the circuitry to the bearing temperatures in a passing train, is defined as the number of times per second that a space between train wheel sets passes the detector. This frequency detection range corresponds to train speeds in the range of 5 miles per hour to 150 miles per hour (absent the asynchronous shutter to be discussed). The distance between wheel sets is not constant throughout the train since wheel sets are not evenly spaced.

Figure 3A:
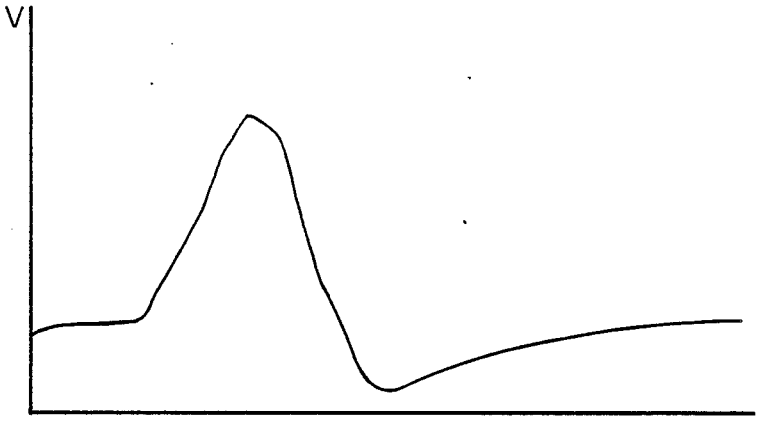
FIGS. 3A, 3B and 3C are graphs illustrating wave forms generated by the circuitry when an overheated journal bearing is detected. Time is displayed on the horizontal axis and temperature is displayed on the vertical axis.
Figure 3B:
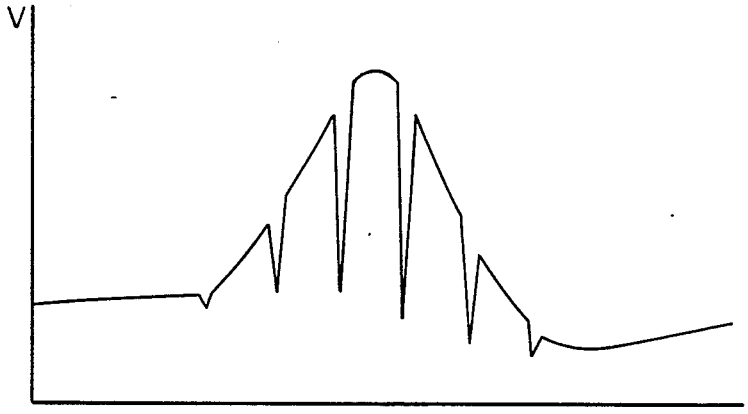

FIGS. 3A and 3B illustrate graphically the output signal from preamp 16 in response to a heat source. In all three graphs, time is displayed on the horizontal axis and voltage is displayed on the vertical axis. The voltage is directly proportional to temperature. Both the time and voltage scales are linear.

Figure 3C:
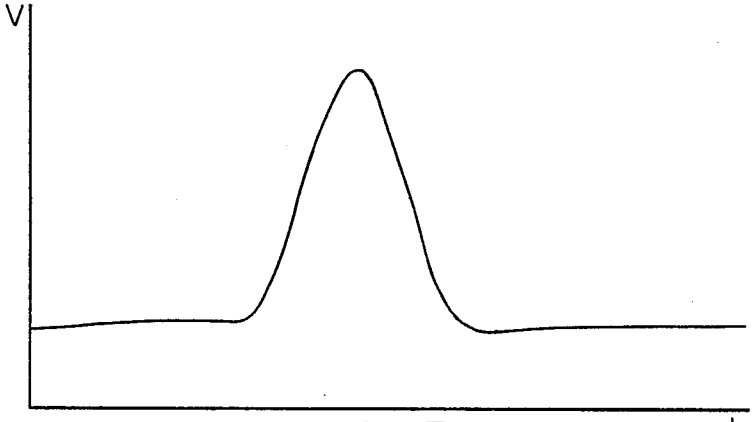

FIG. 3A illustrates the response of preamp 16 to a heat source when a passive-read sensor is used, and the ambient temperature is read from whatever background object passes lens 12. FIG. 3A shows the response to a low frequency (slow moving) heat source with a 3 db thermal degradation. FIG. 3B shows the response to the same heat source when a chop frequency overlay is used to create a reference temperature reading. The chop, or modulation, is created by an asynchronous shutter, as discussed in detail below. FIG. 3C shows the reconstructed analog heat signal of FIG. 3B after processing by microcontroller 24.

Referring again to FIG. 1, the analog voltage output signal from preamplifier 16 is fed to digital gain control 20. The digital gain control 20 is an operational amplifier (hereinafter "opamp") whose gain is controlled by a digital feedback loop and whose output is an analog signal. Digital gain control 20 is an electrically erasable potentiometer (hereinafter "EE pot"), which is an Xicor X9103 in the preferred embodiment. Using the EE pot for digital gain control 20 allows microcontroller (CPU) 24, under software command, to fine-tune the gain continuously, thereby eliminating the need for a technician to service the gain control. It is intended that the EE pot be adjusted only during factory calibration, and not in the field.

The analog signal from digital gain control 20 is transmitted via line 22 to microcontroller 24, which includes an internal analog to digital converter (A/D converter) (not shown separately), which converts the analog signal to a digital signal immediately. All further signal processing and all instructions are preformed digitally. The final output signal is produced by and transmitted from microcontroller 24. The final output signal may be a digital signal appearing on lead set 27. Alternatively, the final output may be taken from digital to analog converter (D/A converter) 29 via line 31 from microcontroller 24, and is shown in FIG. 3C. In either case, the final output is transmitted to remotely located hot box detector circuitry for further processing. Feedback loop 35 from the output of D/A converter 29 to microcontroller 24 monitors the gain in D/A converter 29.

Microcontroller 24 is an Intel 8097BH which comprises a 16-bit microcontroller including all circuits required for fetching, interpreting, and executing instructions that are stored in memory, whether volatile or nonvolatile. Microcontroller (CPU) 24 further includes a program counter, an instruction decoder, an arithmetic logic unit, and accumulators. An external 10 MHz crystal oscillator 23 pulses a clock pulse generating circuit (not shown) inside microcontroller 24 to generate 10 MHz clock pulses, which control all circuit timing functions.

Computer programs, or software, are stored in memory storage units. A suitable memory storage unit used in the preferred embodiment is an electrically erasable programable read only memory (hereinafter "EEPROM") such as an Xicor 28C64, which is an 8-bit memory device. EEPROMs were chosen to facilitate reprogramming that may be desirable during maintenance in the shop. It is not intended that the content of these memory devices will be altered in the field. Clearly, different types of memory units could be chosen, such as simple read only memory (ROM), or programable read only memory (PROM), or, if the ability to reprogram the ROM is desirable, erasable programable read only memory (EPROM), which are conventionally erased by exposure to ultraviolet light. Currently, EEPROMs are not commercially available in 16-bit widths, so the present invention uses two 8-bit EEPROMs operating in concert to provide the 16-bit architecture that allows microcontroller 24 to operate efficiently.

EEPROM 26 contains high byte instructions, that is, the most significant eight digits of the 16-bit instruction set, and EEPROM 28 contains the low byte instructions, that is, the least significant eight bits of each instruction. EEPROMs 26, 28 are of the type commonly referred to as 8K×8 devices and have a capacity of essentially 8,000 bits in an 8-bit package.

Address bus 30 provides a unidirectional address path from address latch 36 to EEPROM 26, EEPROM 28, random access memory (RAM) 32, and address decoder and memory protection unit 34.

Data bus 38 connects EEPROM 26 with address latch 36 and microcontroller 24 to provide a bi-directional data path to carry upper order data. Data bus 40 provides a bi-directional data path between address latch 36, EEPROM 28, and RAM 32 to carry lower order data. Operating in concert, data bus 38 and data bus 40 allow EEPROMs 26, 28 to provide microcontroller 24 with a 16-bit signal width. Conventional control lines 42, 44, 46 from unit 34 are used to select the integrated circuit chip that will be used to process a specific signal, and to read from the PROMs and to read from and write to RAM 32.

THE ASYNCHRONOUS SHUTTER

The present invention employs a rotating shutter 50 which passes between lens 12 and pyroelectric cell 14 to periodically block external sources of infrared from pyroelectic cell 14. During operation, shutter 50 closes to block external infrared about ten percent of the time and allows external infrared to strike pyroelectric cell 14 about ninety percent of the time, that is, shutter 50 provides a duty cycle of ninety percent on and ten percent off. When shutter 50 is closed, the infrared signal is chopped, or modulated, to the ambient temperature inside the housing of detector 10, ensuring a difference between an external heat source and the reference signal (internal housing ambient temperature), as illustrated in FIG. 3B for an exemplary condition in which the internal housing temperature is lower than the temperature of the external source. Shutter 50 comprises an arm with downturned ends presenting two depending shutter blades 54, 56 spaced 180 degrees apart, so that shutter 50 presents a closed condition to pyroelectric cell 14 twice during each revolution of shutter 50. The radial length of the shutter arm from its axis of rotation to each blade 54 or 56 is 1.06 inches (2.7 cm.).

It is desirable that pyroelectric cell 14 be instantaneously exposed to the shutter when the shutter 50 closes so that the entire period of a closed shutter state represents the reference temperature. In operation, however, the change from an external temperature source to the internal reference is not instantaneous, and the resulting chop of the incoming infrared is not a straight drop to the reference temperature, as, for example, a square wave would be. This characteristic requires certain adjustments in the sampling rates microcontroller 24 uses to generate temperature readings, as described in detail below.

Shutter 50 is rotated by shutter motor 52, which is a brushless military-grade direct current electric motor having stainless steel ball bearings and which is highly shock resistant. Shutter motor 52 is driven by pulsed direct current from motor controller 55 whose output is controlled by microcontroller 24 and associated software, which control a field effect transistor (FET) (not shown separately). The frequency of the closed shutter 50 condition, or chop rate, is preferably 150 Hz (shutter rotation of 75 revolutions per second, or 4,500 revolutions per minute), which is approximately twice the 82 Hz modulation frequency of train wheel sets passing the detector at 150 miles per hour. This chop rate ensures that the closed shutter condition will not block more than about one and one-half inches of the circumference of a journal bearing from view by lens 12 even if the train is traveling 150 miles per hour. At this speed, the heat sample (a journal bearing) is within the scanning zone for only three to four milliseconds. With a 45 degree scan angle by lens 12 and pyroelectric cell 14 relative to a journal, the detector can scan 180 degrees of the journal bearing over a distance of about 14 linear inches (33 cm.). A chop frequency that chops only one and one-half inches from this fourteen inch scan at a train speed of 150 miles per hour provides an excellent reading of the journal bearing temperature, while also providing a valid reference temperature.

A conventional wheel transducer (advance transducer) on the track (not shown) is located 150 feet or more ahead of a pair of spaced wheel transducers that define the beginning and the end of a scanning zone through which the circuitry is receptive to infrared radiated from the passing train. Such transducers are conventionally utilized in hot box and hot wheel detectors, with the transducer pair defining the scanning zone (referred to hereinafter as the gate on and gate off transducers respectively) typically being spaced apart longitudinally along the rails a distance of about 17 inches (43 cm.). Accordingly, the advance transducer transmits a signal to microcontroller 24 via line 57 when a train wheel passes over it. This signal is used to turn on shutter motor 52 and to prepare the circuitry for the subsequent processing of heat signals once the wheel trips the gate on transducer and enters the scanning zone. Software routines (primarily the Train Pass routine) keep shutter 50 in the on state until the entire train has passed. Train Pass basically includes a timer that times out and shuts off shutter motor 52 if no more train wheels enter the scanning zone. Naturally, if a train merely stops for a time, shutter motor 52 will stop and the sensing unit will not output heat signals, but the unit will immediately start again when the train resumes travel.

A wheel gate signal on line 58 from the gate on transducer causes microcontroller 24 to generate a final output on lead set 27 that is representative of the temperatures of the journal bearings scanned. This final output results from sampling the input signal to microcontroller 24 from digital gain control 20 via line 22 at a sampling rate of about 3,000 Hz while shutter 50 is open and about 10,000 Hz when shutter 50 is closed. These sampling rates are empirically determined and should be at least twice the maximum input frequency. The sampling rate is increased for the shutter closed state because this state causes a nearly sinusoidal transient signal, rather than the idealized square wave drop from the external temperature to the shutter temperature. The software chooses the lowest sampled value to calculate the temperature in the shutter closed position. Sampling frequency increases the probability of getting a more accurate shutter temperature reading.

When the train wheel leaves the scanning zone, a wheel gate signal from the gate off transducer (not shown) is transmitted via line 60 to microcontroller 24. This gate off signal indicates that the train wheel has passed through the wheel gate transducers defining the scanning zone, and causes microcontroller 24 to stop generating an output signal since no further information is available from the wheel that has passed out of the zone.

While the train wheel is between the wheel gate transducers, its temperature is scanned by the detector. During this scanning time, shutter 50 chops the signal to provide a reference signal as shown in FIG. 3B by the regularly spaced notches 51 in the output signal from preamp 16. To prevent the low heat signal generated during the shutter-closed state from being transmitted as a journal bearing temperature, optical switch 62 is provided. When shutter blade 54 blocks pyroelectric cell 14 from infrared, shutter blade 56 blocks optical switch 62, comprising light emitting diode (LED) 64 and phototransistor 66. Shutter blade 56 interrupts the output signal of optical switch 62, which via line 68, informs microcontroller 24 that shutter 50 is closed, a reference temperature is being taken, and not a bearing temperature. Microcontroller 24 then continues to output the latest sample taken prior to the closed shutter state, until the wheel leaves the scanning zone.

The output from optical switch 62 is also used to measure the revolutions per unit time of shutter 50. This information may be used to control the speed of shutter motor 52. If, for example, shutter 50 is rotating too slowly for a given train speed, not enough of the bearing will be scanned to provide an accurate temperature reading, and the shutter rotation must be increased. If, on the other hand, shutter 50 is rotating too rapidly, the reference temperature generated by the signal chopping action of the shutter may not be accurate, and the shutter must be slowed. This is easily accomplished through software controls operating in concert with microcontroller 24, which act on motor control 55, which in turn increase or decrease the shutter speed. However, speed control of the shutter is not required in most applications. It is sufficient to allow shutter 50 to rotate at the maximum speed of electric motor 52, that is, about 4,500 rpm.

THE PREAMPLIFIER

Figure 2:
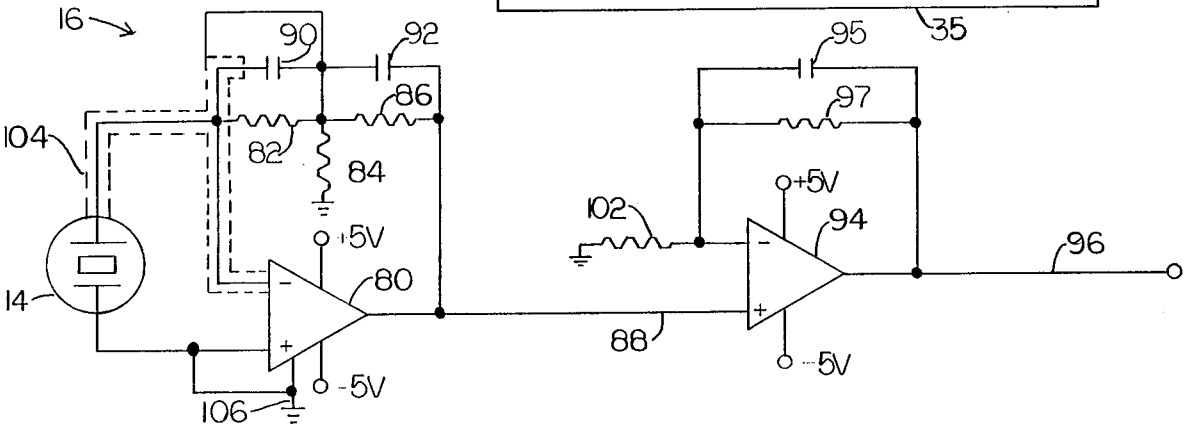
FIG. 2 is an electrical schematic diagram of the pyroelectric cell and related preamplifier of the preferred embodiment of the present invention.

Referring to FIG. 2, there is shown a schematic diagram of preamplifier 16 comprising a two-stage analog amplifier. Stage one responds to the current responsivity of the cell 14 and comprises a monolithic electrometer operational amplifier (opamp) 80, and a T-network feedback loop including resistor 82, resistor 84, and resistor 86 and associated components and power inputs. Opamp 80 is a field effect transistor (FET) integrated circuit such as a Burr-Brown OPA128, designed for measuring and amplifying extremely low currents. Together with the T-network feedback loop, opamp 80 converts the analog input current signal from pyroelectric cell 14 to an analog voltage output signal on lead 88.

The current output from pyroelectric cell 14 is extremely small, usually less than 100 picoampere and the signal-to-noise ratio is very low. Accordingly, a gain of more than 100 million times the input signal is required of the stage one amplifier. FET opamp 80 and the T-network feedback meet these requirements.

FET opamp 80 has an input bias current specification of +/−75 fA and thereby reduces the errors from input bias current. The T-network feedback eliminates the impedance problems that could be caused by moisture and other contaminates that find their way into the detector housing in the field. The T-network feedback loop allows the use of lower value resistors to produce the same effect as a much higher feedback resistance.

A conventional low current amplifier configuration would employ a single high value resistor in a feedback loop. Such circuits require a resistor of about 1 to 10 Gohms. When such a large resistor is used, its resistance combines with the capacitance of the printed circuit board itself to cause distortions in the frequency response of the pyroelectric cell. Namely, the current response becomes non-linear and drops sharply at an input frequency that is too low for monitoring moving train journal bearings. Use of the T-network feedback loop eliminates this problem, as discussed immediately below.

The network of resistors 82, 84, 86 has a shortcircuit transfer impedance that makes it equivalent to a $$R_f = R82 + R86 + \frac{R82 \times R86}{R84}$$

An effect of this function is that a high input resistance and a high gain can be achieved without high-level feedback resistors. The T-network feedback loop allows the circuit to have high frequency response with high gain. These characteristics permit highly accurate measurements of transient infrared signals, such as those presented to pyroelectric cell 14 during a closed shutter state. Operating in conjunction with the filter and smooth software routine (see below), it also achieves a good signal-to-noise ratio that may have been lost during initial signal processing.

Capacitor 90 and capacitor 92 provide high frequency filtering and are matched to the capacitance of the feedback network and the load capacitance. The load capacitance presented by pyroelectric cell 14 ranges from about 10 picofarads to about 20 picofarads (pF), depending on manufacturer and lot. The impedance of a pyroelectric cell is about $10 \times 10^{13}$ ohms. By selecting the appropriate values for resistors 82, 84, and 86, the gain from opamp 80 can be maximized up to the desired maximum train speed, or frequency. In choosing the values of resistors 82, 84, and 86, and the values of capacitors 90 and 92, the capacitance of the resistor-capacitor circuit formed by the load capacitance, resistor 82 and resistor 84 should be taken into account in accordance with well known mathematical relationships that describe such networks.

All specific values for resistors and capacitors provided herein were derived for use in a system tuned for a specific pyroelectric cell, the Eltec S400M8-8, and may not be exactly appropriate for others. With this caveat, examples are as follows: resistor 82 is 47 megohms, resistor 84 is 1,000 ohms, and resistor 86 is 200,000 ohms; capacitor 90 is about 1.0 pF and capacitor 92 is about 310 pF. This T-network provides an effective resistance of about $9.45 \times 10^9$ ohms.

The second stage amplifier of preamp 16 consists of analog operational amplifier (opamp) 94, preferably an integrated circuit amplifier such as a generic OP-77 operated as a non-inverting voltage mode amplifier, with associated resistance-capacitance (RC) feedback and power inputs. Capacitor 95 is 2,000 pF and resistor 97 is 62,000 ohms, and they are grounded through 10,000 ohm resistor 102. Opamp 94 amplifies the voltage signal from opamp 80 and transmits a suitable analog output to microcontroller 24 via line 96. The signal is now strong enough and clean enough for the A/D converter within microcontroller 24 to accurately determine the temperature of objects scanned by pyroelectric cell 14.

Guard trace 104 (shown in broken lines in FIG. 2) provides circuit protection against high impedance shorts that might result from foreign objects contaminating the printed circuit board in the field and causing noise interference. With guard trace 104 in place, a contaminating resistance of less than forty megohms would be required to affect circuit performance. Ground connection 106 provides a ground for the positive side of pyroelectric cell 14 and the non-inverting input of opamp 80.

Preamp 16 and pyroelectric cell 14, as described, are capable of a response time, i.e., the period from impingement of infrared on pyroelectric cell 14 to an equilibrium output signal on lead 96, of about 300 microseconds to about 500 microseconds. The response time achieved by the detector is more than adequate to measure journal bearing or wheel temperature accurately on even the fastest trains.

THE MECHANICAL STRUCTURE

Figure 4:
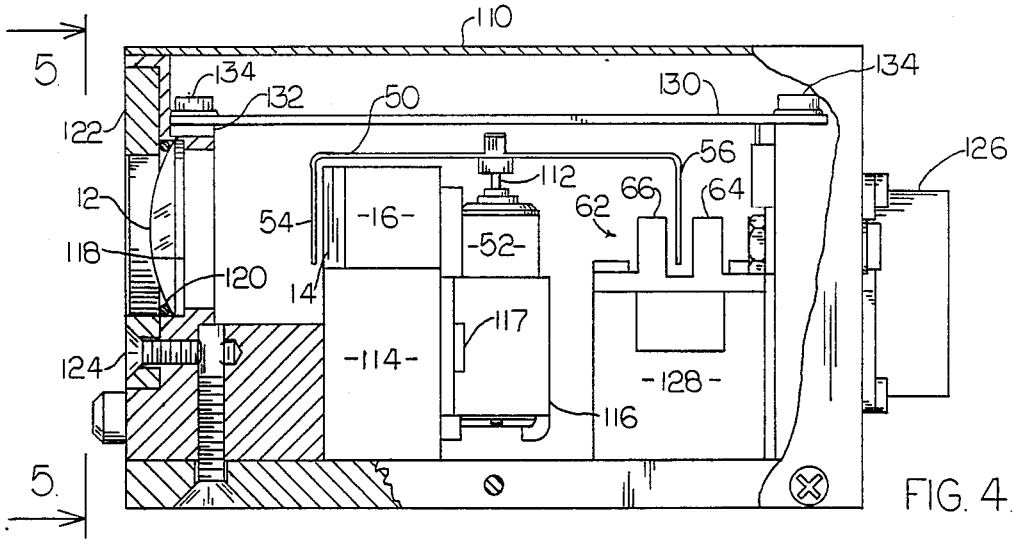
FIG. 4 is a side elevation, partially in section, of the infrared scanning circuit and related hardware enclosed in a housing.
Figure 5:
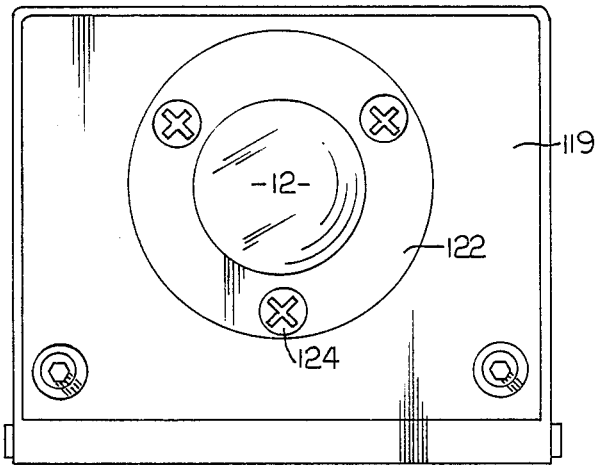
FIG. 5 is a front elevation of the housing shown in FIG. 4, taken along line 5—5 of FIG. 4.
Figure 6:
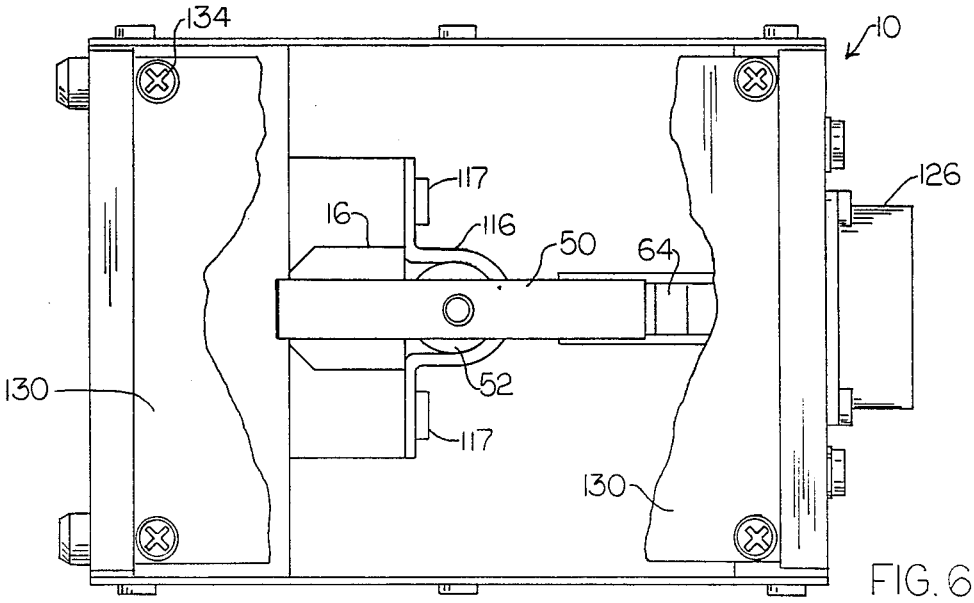
FIG. 6 is a plan view of the infrared scanning circuit housing and interior components, with the top and underlying circuit board partially cut away.

Referring to FIGS. 4–6, there is shown the detector 10 self-contained in a housing 110 except for an external power supply (not shown), leads from the wheel transducers, and signal transmission lines (not shown) that conduct the output signal to the remote hot box detector processing circuitry. These lines run through bayonet type connector 126 connected to the back of housing 110. Shutter 50, shown in the shutter closed state, is fixed to drive shaft 112 of shutter motor 52, which is secured to a mounting block 114 by motor clamp 116 and fasteners 117. Pyroelectric cell 14, and preamp 16, which are electrically connected to one another, are mounted on the top of block 114 and are disposed behind and in alignment with depending shutter blade 54 and germanium lens 12.

Lens 12 is seated in a recess 118 in the front wall 119 of housing 110 and sealed by 0-ring 120, and is clamped into recess 118 by collar 122 secured to wall 119 by fasteners 124. The optical switch 62 is mounted on top of a support 128, and consists of light emitting diode 64 and phototransistor 66 spaced apart and, as shown in FIG. 4, separated by depending shutter blade 56.

Mother board, or primary printed circuit board, 130 is horizontally disposed in the upper portion of housing 110, and includes essentially all electrical components except preamp 16. Mother board 130 is fastened to landings 132 by fasteners 134.

THE SOFTWARE

The primary program, or Main Program, includes a few initialization routines, and three separate important routines, which can be interrupted at any point during execution to service any one of several interrupts. All other software routines are interrupts of one type or another, which are self-activated as required. The discussion of the software is presented in outline form and the subroutines in the FIGS. are labeled with the outline numbers.

Figure 7:
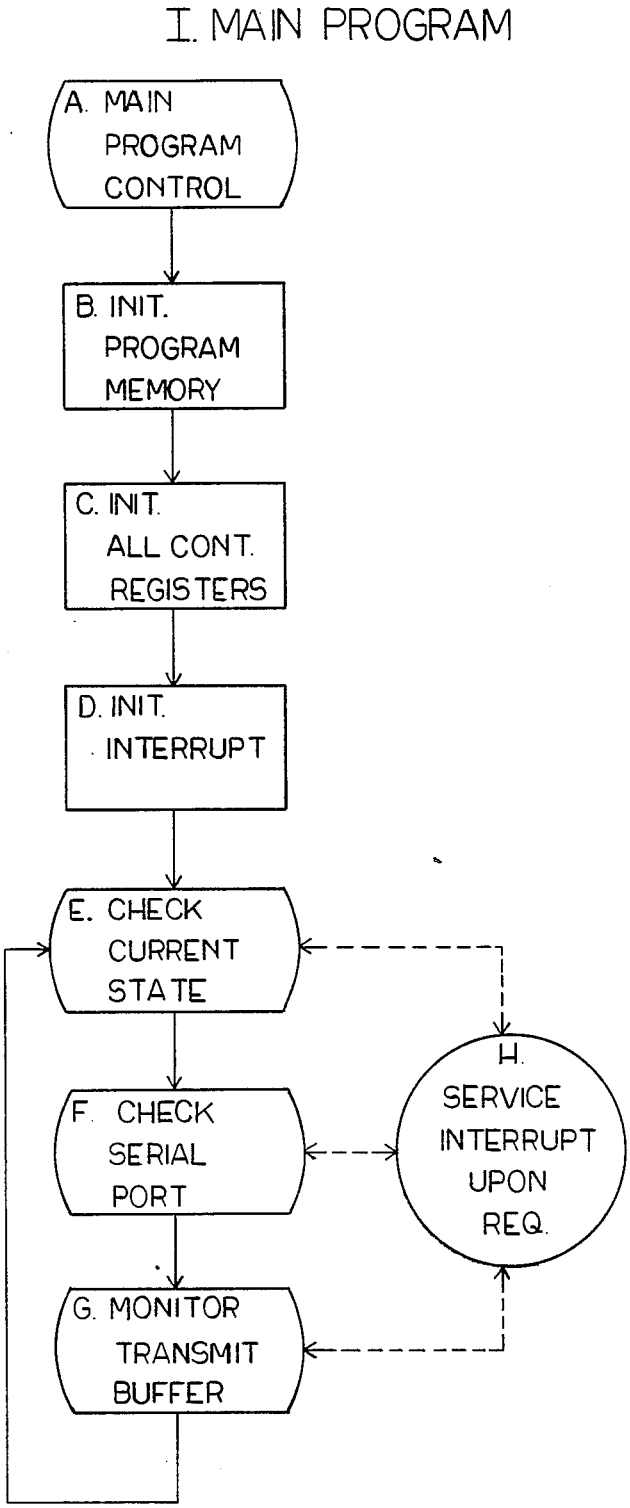
FIGS. 7–12 are block diagram flow charts of the software written to operate and control the central processing unit.

The software is embedded in EEPROMs 26, 28. Referring to FIG. 7, there is shown a block diagram flow chart for the primary computer program, or Main Program, for the apparatus for detection of overheated railroad wheel components. This Main Program is a free-running loop program, subject to servicing interrupts. After an interrupt routine has been completed, the program returns to the Main Program, which resumes execution at the point where it was interrupted.

I. THE MAIN PROGRAM. The Main Program is illustrated in outline form in FIG. 7 and includes the following routines.

A. The Main Program Control Routine. This routine starts the main program when a reset instruction is received from microcontroller 24.

B. The Initialize Program Memory Routine. This routine initializes RAM 32 to the states required for proper program control and flow.

C. The Initialize All Control Registers Routine. This routine initializes the control registers to permit processing of high speed inputs from optical switch 62 and wheel gates A (gate on) and B (gate off), which signal when a wheel enters the scanning zone and when a wheel leaves the scanning zone, respectively, on lines 58, 60 (see FIG. 1). In addition, this routine permits the Pulse Width Modulator (PWM), Timers, and External Interrupts to operate. The PWM is an integral internal part of microcontroller 24 that, under software command, controls the pulse width of the final analog output signal from D/A converter 29 on line 31.

D. The Initialize Interrupts Routine. This routine enables the Main Program to accept the interrupt routines. If the program gets lost or fails for any reason after it begins execution, a conventional watchdog timer (not shown) resets the program back to the starting address. After these three initialization routines have been performed, the Main Program begins execution of the primary Main Program loop, which includes: (1) Check Present State; (2) Check Serial Port; and (3) Monitor Transmit Buffer, augmented by the Service Interrupt Upon Request Routine, as discussed immediately below.

Figure 8A:
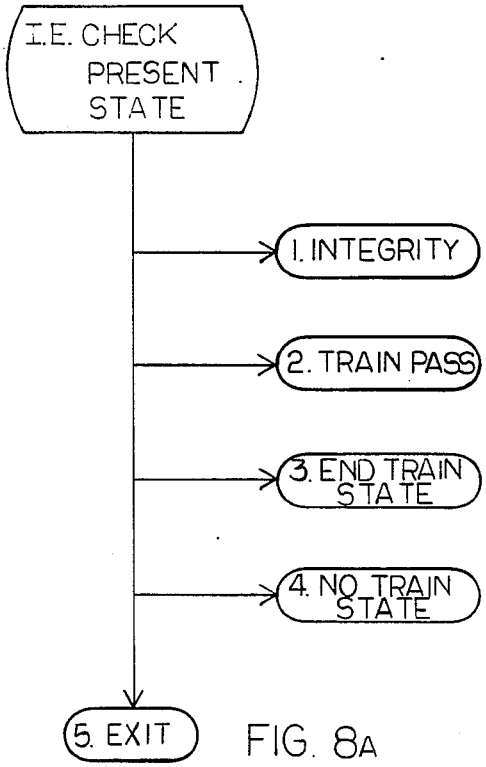

E. The Check Present State Routine. Referring to FIG. 8A, this routine determines which of the following states the apparatus is in: (1) integrity—the system is taking an integrity test to determine if it is operating properly; (2) train pass—the system is monitoring a passing train; (3) end train—the system has seen the end of a train; or (4) no train—the system is in an idle state because no train is present, in which case the routine (5) exits to the Main Program.

Figure 8B:
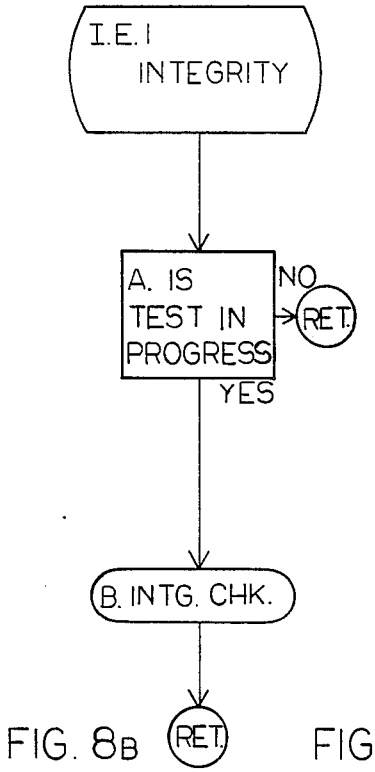

1. The Integrity Routine. Referring to FIG. 8B, the Integrity routine checks all circuits, memory locations, and so forth to determine whether the apparatus is working properly. If it is not, the Integrity Routine causes an integrity failure signal to be transmitted via leads 27 (digital), 31 (analog) to the remote signal processing equipment.

a. Is test in progress subroutineThis subroutine determines whether an integrity test is in progress, and if so, allows the test to continue. It no test is in progress, this subroutine returns the program to the Main Program.

b. Integrity Check Routine. This is a major subroutine that checks to ensure proper operation of the infrared scanning circuit, and is discussed in detail at section II, below. When an integrity check has been successfully completed, the program is returned to the Check Present State routine at the beginning of the Train Pass routine.

Figure 8C:
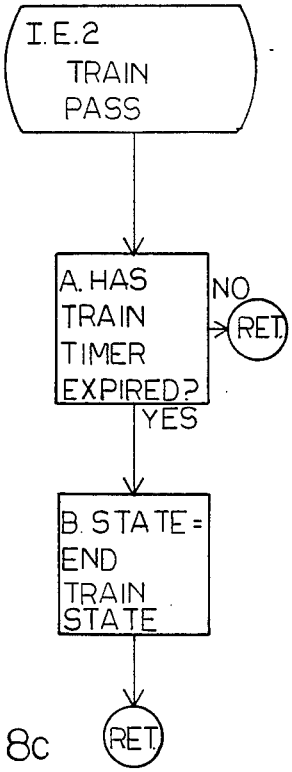

2. The Train Pass Routine. Referring to FIG. 8C, this routine responds to a signal from wheel gate A, which indicates that a train is passing, by turning on shutter motor 52 and enabling the temperature measurement circuits.

a. Has timer expired subroutine. When a train wheel leaves the scanning zone, as indicated by a signal from a wheel sensor at wheel gate B, this subroutine begins counting time. If more than ten seconds elapses before another wheel enters the scanning zone, this subroutine assumes that the last car of the train has passed and the program proceeds to the next subroutine. If, alternatively, another wheel enters the scanning zone within the ten second period, this subroutine returns the program to the Train Pass Routine, which allows continued temperature measurements to be taken.

b. State=end train state subroutine. This subroutine takes over when the "has timer expired subroutine" determines that the last car of the train has passed. This subroutine returns the program to the Check Present State Routine, which proceeds to the next subroutine.

Figure 8D:
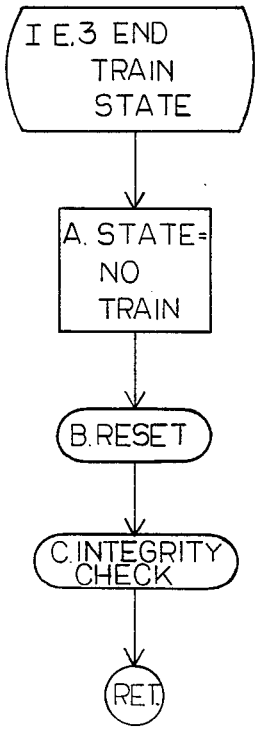

3. End Train State Subroutine. Referring to FIG. 8D, this routine is entered when the "State=end train state subroutine" is reached, and triggers the next subroutine.

a. State=no train subroutine. This subroutine sends the software back to the idle state and passes execution to the next subroutine.

b. Reset subroutine. This subroutine then resets all necessary memory locations for the next state by dumping all data accumulated during scanning of the train that has passed.

c. Integrity Check Routine. After a train has passed, an integrity check is performed (see "II," below) and the results of the integrity check are transmitted out the serial port on leads 25 (digital, 31 (analog) Then execution of the program is returned to the Check Present State routine.

Figure 8E:
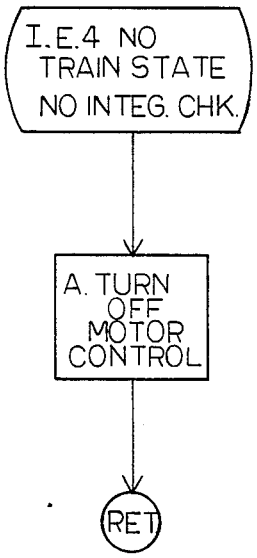
Figure 8F:
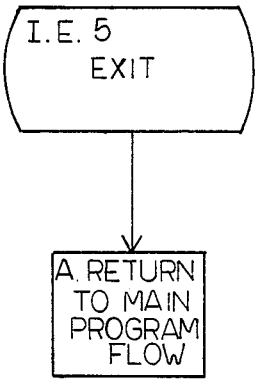

4. No Train State - No Integrity Check State Routine. Referring to FIG. 8E, this subroutine expresses the state of the software when no train is being scanned and no integrity check is being conducted.

a. Turn off motor control subroutine. This subroutine turns off shutter motor 52 and returns the program to the "Check Present State" routine.

5. Exit Routine. This routine returns control of the software to the Main Program, through the following subroutine.

a. Return to Main Program flow subroutine. This subroutine is addressed after all necessary subroutines of the "Check Present State" routine have been executed, and returns execution of the software to the Main Program.

F. Check Serial Port Routine. Referring again to FIG. 7, this routine checks to determine whether a message is being received through the serial port via line 25 from the remote hot box detector. Usually, such messages alert the infrared scanning circuits that a train is approaching and initiate preparations for scanning the journal bearings. See "Train Coming Interrupt routine, below.

G. Monitor Transmit Buffer Routine. Shown in FIG. 7, this routine monitors the transmit buffer, which is located in RAM 32 to determine whether the buffer contains a message that needs to be sent. If no message is present in the buffer, the Main Program continues. If a messages is present in the buffer, this routine ensures that it is transmitted, and continues to monitor the buffer until the buffer is empty, when this routine returns execution of the software to the Main Program.

H. Service Interrupt Upon Request. The circle in FIG. 7 does not illustrate an actual software routine. It is intended to show how interrupt service routines can interrupt the Main Program at any point. The interrupt service routines, which will be discussed in the listed order, include: (1) Integrity Check Routine; (2) Train Coming—Train Gone Routine; (3) High Speed Input Interrupt Routine; (4) External Interrupt Routine; and (5) D/A Conversion Interrupt Routine.

Figure 9:
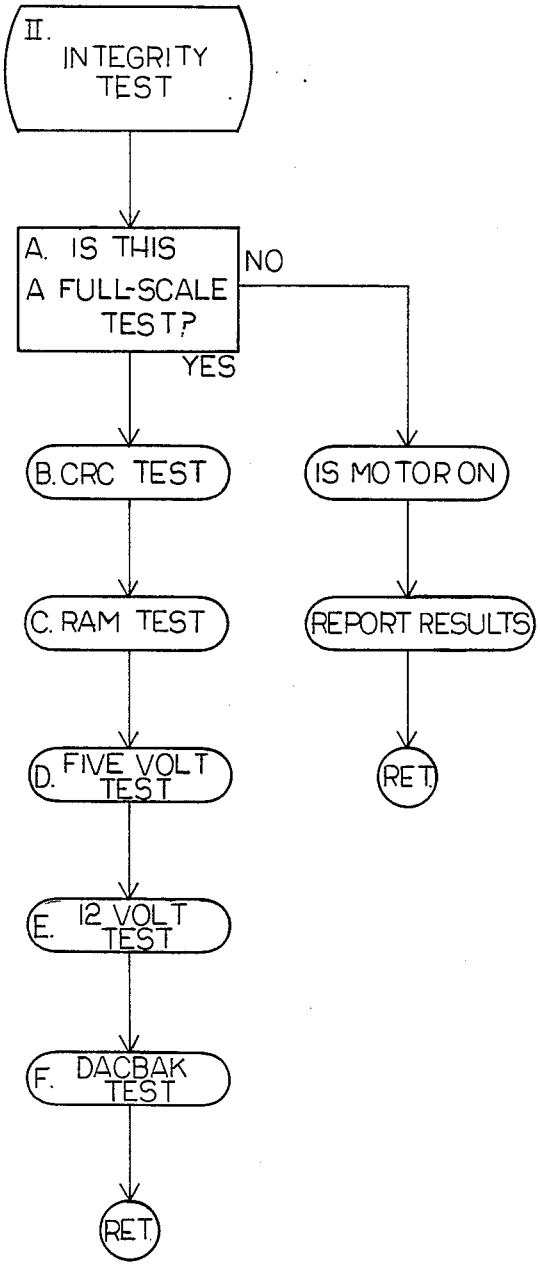

II. INTEGRITY TEST ROUTINE. Referring to FIG. 9, this routine performs two different integrity tests. The full-scale integrity test is a complete test of all electronic circuit elements, memory locations, and so forth, and is automatically performed every two minutes unless a train is approaching the scanning unit or is passing the scanning unit. The second integrity test is an abbreviated version, or short version integrity test, of the first integrity test. The short version is performed whenever a train is approaching the scanning unit. An important function of the short version integrity test is to report the results of the latest full-scale integrity test to the remote signal processing equipment.

If an error is found by any of the integrity routines and subroutines of the Integrity Test Routine, the program immediately goes to the "Report Results" subroutine, which transmits an integrity failure signal to the remote signal processing equipment.

A. The Is This The Full-Scale Integrity Test Routine. The Integrity Test Routine is invoked either (1) when two minutes have passed since the end of the previous full-scale integrity test and no train is present or approaching; or (2) when a train is approaching. The Is This The Full-Scale Integrity Test routine is not invoked until the Integrity Test Routine is underway.

The Is This The Full-Scale Integrity Test routine then determines whether the full-scale integrity test or the short version is in progress. It the full-scale integrity test is being performed, the software proceeds to the next routine in the full-scale integrity test.

If, however, a train is approaching, as indicated by a remote wheel sensor that transmits a signal to the infrared scanning unit on external interrupt line 61, the short version will be conducted. The short version consists of the "Is Motor On" routine and the "Report Results" routine.

The "Is Motor Running" routine determines whether shutter motor 52 is on, and, if not, turns it on. Then the "Report Results" subroutine is called, which transmits the results of the latest full-scale integrity test (which were stored in RAM) out serial port line 27 and analog line 31 to the remote signal processing unit. Then this subroutine returns execution of the software to the Main Program.

B. The Cyclical Redundancy Test Routine. This routine, in conjunction with conventional checksum tests (not shown), performs nondestructive tests on the values stored in selected memory locations. If the apparatus passes the CRC test, the software proceeds to the next routine.

C. The RAM Test Routine. This conventional routine performs a nondestructive test on selected low locations in the program stack, which is stored in RAM 32. It also preforms a destructive test on those RAM locations used to store temporary variables during scanning and those RAM locations used as transmit buffers.

D. The Five Volt Test Routine. This routine measures the five volt power supply output and determines whether that output is within tolerance. If so, the software proceeds to the next routine. If not, this routine issues an integrity failure signal that is transmitted to the remote signal processing equipment.

E. The Twelve Volt Test Routine. This routine measures the twelve volt power supply output and determines whether that output is within tolerance. If so, the software proceeds to the next routine.

F. The DACBAK Test Routine. "DacBak" is an abbreviation for "digital to analog converter feedback loop," that is line 35 in FIG. 1. This routine writes specific known values into the pulse width modulator control circuits. Then it monitors the output of the pulse width modulator as measured on line 35 and determines whether the resulting output is within predetermined tolerances. If so, the software proceeds to the next routine.

Figure 10:
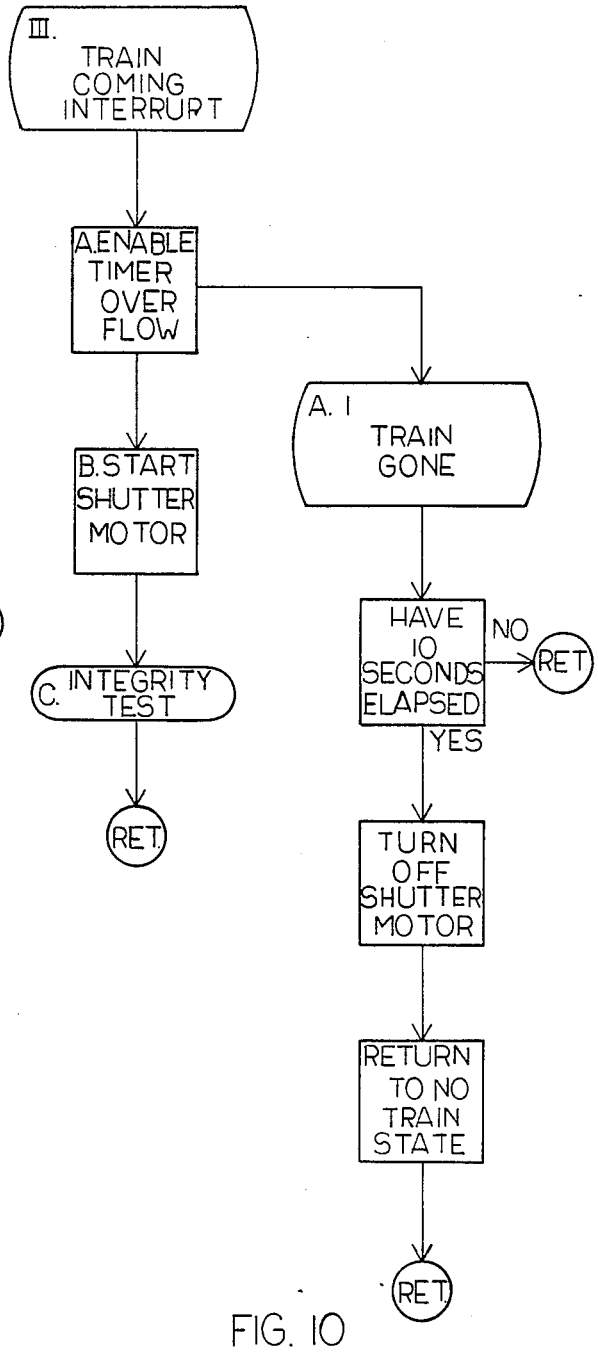

III. TRAIN COMING—TRAIN GONE INTERRUPT ROUTINE. Referring to FIG. 10, this routine is invoked when the remote signal processing equipment transmits a signal that a train is approaching the scanning zone (train approaching signal). The train-approaching signal is conventionally developed by a wheel sensor located on the tracks about 150 feet away from the scanning zone. It is received by the infrared scanning unit on external input line 61 (see FIG. 1). This routine prepares the infrared scanning unit for scanning a train.

A. The Enable Timer Overflow Routine. This instructional routine enables the Timer Overflow Interrupt routine.

1. The Timer Overflow Interrupt (Train Gone) Routine. This routine sets up and starts the software timer that signals the end of the train by assuming that if no new train wheel enters the scanning zone within ten seconds after a wheel has left the scanning zone, the end of the train has passed the scanning zone. This routine operates in conjunction with &he "has timer expired" subroutine of the "Check Present State Routine," discussed above.

a. The has ten seconds elapsed subroutine. This subroutine monitors the condition of the software timer started by the previous routine. If ten seconds has not elapsed prior to resetting the timer in response to another train wheel entering the scanning zone, then this subroutine returns the software to the Main Program, where it continues monitoring the temperatures of passing wheel and axle components. When ten seconds has elapsed without another wheel entering the scanning zone, this subroutine invokes the "turn off shutter motor" subroutine, which shuts off the shutter motor, and causes the software to enter the "return to no train state" subroutine (see section I.E.4, "No Train State" subroutine of the Check Present State Routine, above). The "return to no train state" subroutine puts the software into an idle state and then returns control of the software to the main program.

B. The Start The Shutter Motor Routine. This routine starts shutter motor 52 when the approach of a train is signaled by the remote signal processing equipment so that it can be spinning at full speed when the train reaches the scanning zone.

C. The Integrity Test Routine. This routine is well described above. When invoked here, it performs a short version integrity check, which will be completed prior to the arrival of the train in the scanning zone. When the short version integrity test has been successfully completed, the software is returned to the Main Program.

Figures 11A, 11B:
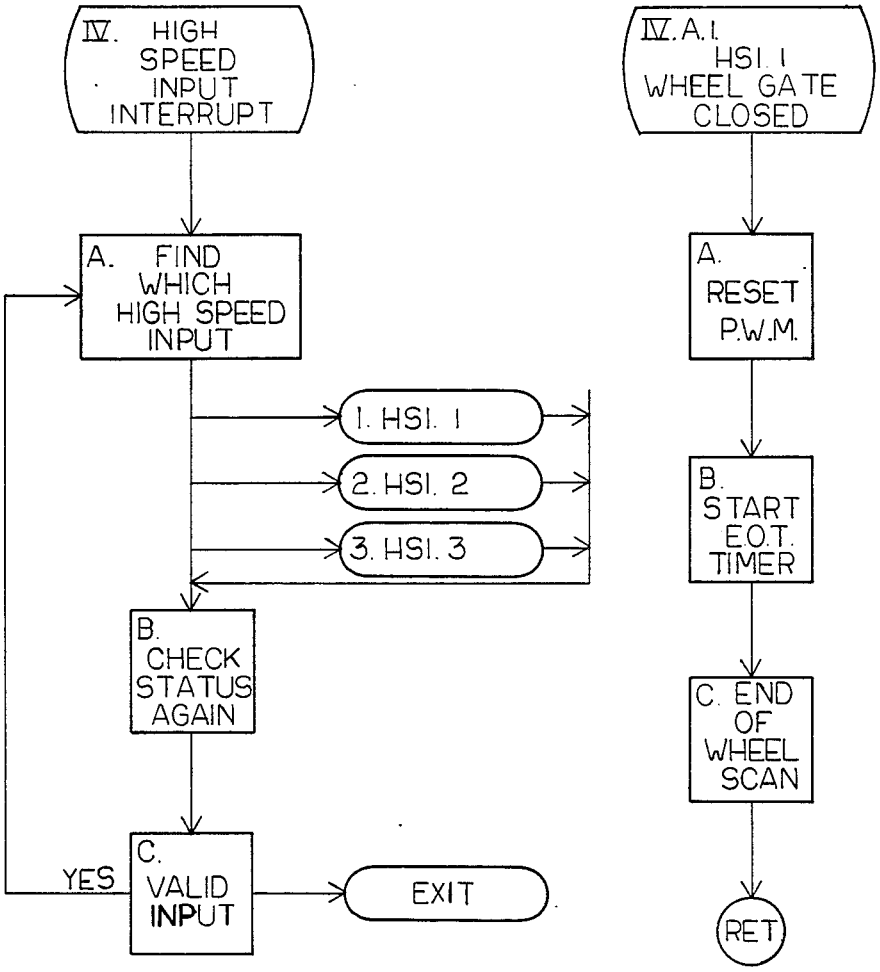

IV. HIGH SPEED INPUT INTERRUPT ROUTINE. Referring to FIG. 11A, this routine allows high speed events to interrupt execution of the software in order to monitor and process data regarding the temperature of the wheel components being scanned. A high speed input interrupt (HSI) can be generated by any one of the following three sources: (1) a wheel enters the scanning zone; (2) a wheel leaves the scanning zone; or (3) optical switch 62 is turned off by the passage of shutter 50 between LED 64 and phototransistor 66. These inputs are connected to the high speed input pins on microcontroller 24, which provide a faster response to input data than other input pins on microcontroller 24.

A. The Find Which HSI The Input Is Routine. This routine processes the incoming data to determine which of the three HSI listed above is causing the interrupt, and then causes the program to proceed to the appropriate subroutine, as listed immediately below.

1. The HSI.1 (Wheel Leaving the Scanning Zone) Routine. Referring to FIG. 11B, this routine is initiated by the signal from the remote signal processing equipment that indicates a wheel has left the scanning zone. This routine then causes the infrared scanning unit to stop taking heat samples from pyroelectric cell 14 and preamp 16. It also causes the software to proceed to the next subroutine.

a. The reset PWM subroutine. The subroutine resets the pulse width modulator (PWM), which must be reset an the end of each wheel scan to ensure an accurate analog signal is transmitted from D/A converter 29.

b. The start EOT timer subroutine. This subroutine restarts the end of train timer to count down from a preset value until it times-out after ten seconds, or another wheel enters the scanning zone (see FIGS. 8, 10 and the related discussion for end of train timer uses).

c. The end of wheel scan subroutine. This subroutine sends a special ending byte to serial port lead 27 as soon as a wheel leaves the scanning zone. This ending byte is transmitted out the serial port to the remote signal processing equipment, signaling that no more data about that wheel will be transmitted. No corresponding signal is transmitted via analog output line 31. Conventional analog signal remote processing equipment does not require such a signal.

Figure 11C:
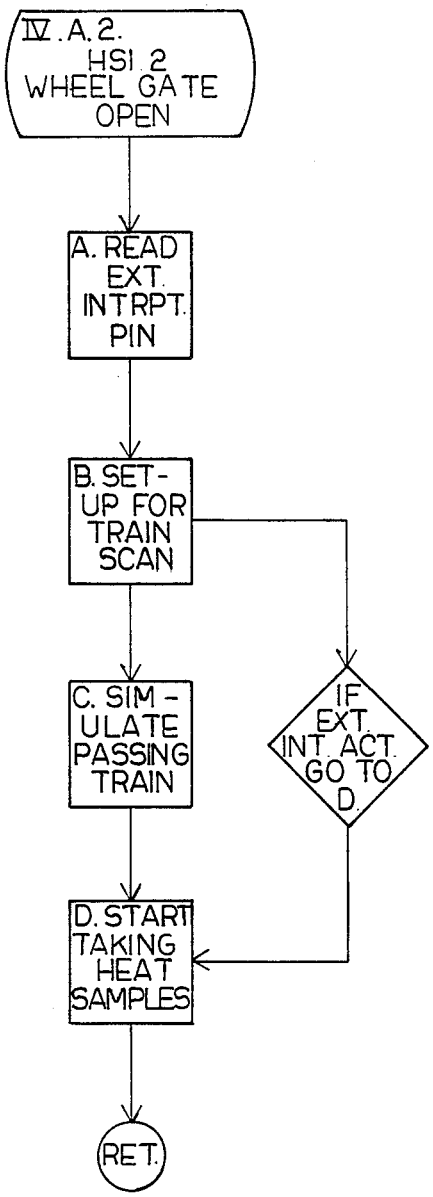
Figure 11D:
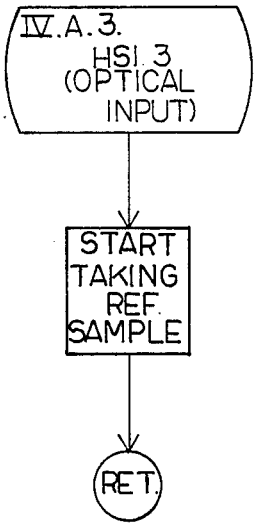

2. The HSI.2 (Wheel Entering the Scanning Zone) Routine. Referring to FIG. 11C, this routine is invoked whenever a wheel enters the scanning zone, which triggers a wheel sensor on the track that produces a signal ultimately received by the infrared scanning unit on external interrupt line 61 (see FIG. 1). This signal from the hot box detector instructs the infrared scanning unit to: (1) transmit the results of the most recent full-scale integrity test to the remote signal processing equipment, and (2) to begin sampling heat samples from the wheel that is in the scanning zone.

a. The read the external interrupt input pin subroutine. If this lead is active, the integrity test from the hot box detector is in progress.

b. The setup for train scan subroutine. This subroutine ensures that the initial values for certain variables used in processing heat samples from the passing wheel components are restored to their appropriate initial values prior to taking new heat samples. Further, if the "read the external interrupt input pin" subroutine, detects an active signal on the external interrupt input on line 61 (see FIG. 1), this subroutine forces the program to go to the "start taking heat samples" subroutine, skipping the "simulate passing train subroutine."

c. The simulate passing train subroutine. This subroutine turns the wheel gates on and off to simulate the passage of a train when no train is present, causing the shutter motor to be turned on and the scanning unit to process heat samples. This routine is invoked during actual field testing of the entire unit by trackside personnel who hold a heat source in front of lens 12 and check the output from the infrared scanning circuit. This subroutine is not used during normal operation of the infrared scanning unit. If a train is being scanned, this subroutine is skipped.

d. The start taking heat samples subroutine. This subroutine sets up the A/D converter in microcontroller 24, which starts taking heat samples from pyroelectric cell 14. These samples are processed by the A/D Conversion Interrupt routine, discussed below at section V. When no more train wheels are expected, that is, the end-of-train timer times-out, this subroutine returns the software to the Main Program.

3. The High Speed Input.3 (Optical Input) Routine. Referring to FIG. 4, this routine starts taking heat samples from depending shutter blades 54, 56 as they rotate between lens 12 and pyroelectric cell 14 to determine the reference temperature and ensure a change in the amount of infrared striking pyroelectric cell 14 over time. When no more train wheels are expected, that is, the end-of-train timer times-out, this subroutine returns the software to the Main Program.

V. INTERRUPT UPON A/D CONVERSION ROUTINE. This routine is called every time that an A/D conversion is completed. A/D conversion takes place in circuit hardware, under software command. Each analog signal that is converted to a digital signal is expressed as a two byte, sixteen bit number. The ten most significant digits of the sixteen bit number carry the information of the signal. The three least significant bits carry an identification tag, or channel number. The Interrupt Upon A/D Conversion Routine directs each digital signal to the appropriate software routine for further processing, using the three bit channel number to determine exactly where to send each digital signal.

Figure 12:
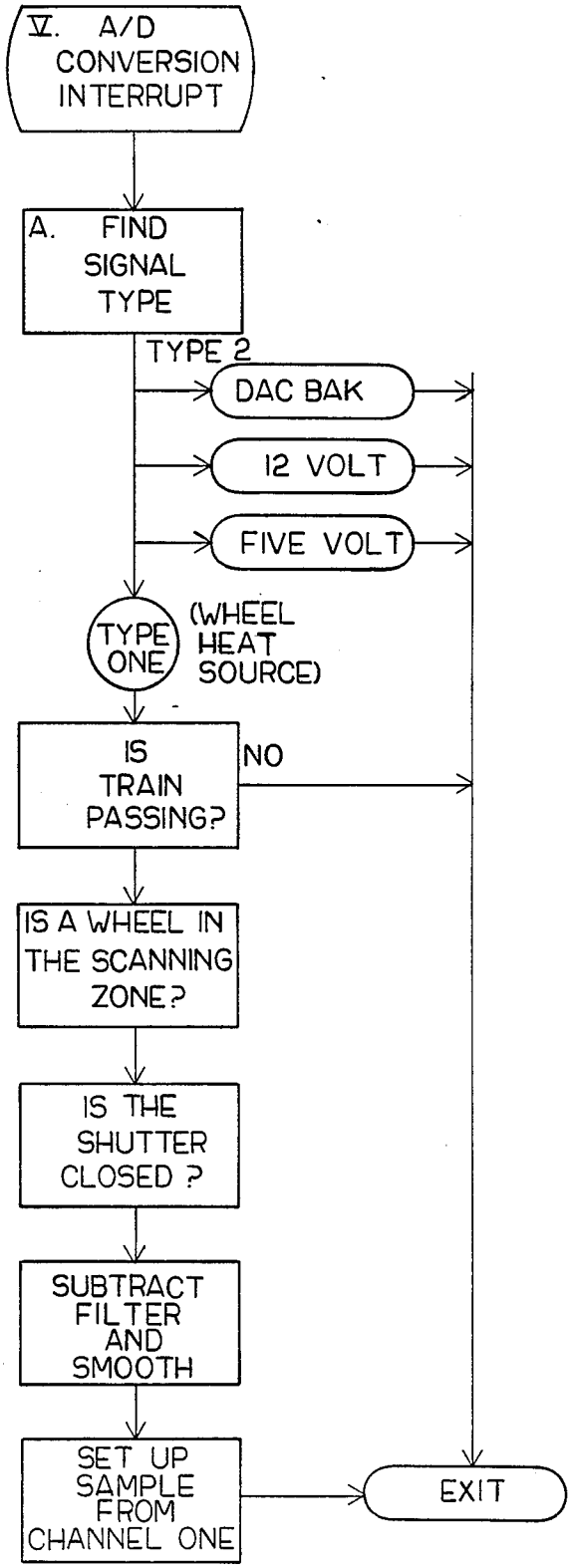

Referring to FIG. 12, signals requiring distribution to various software routines are of two basic types, which are: type (1) internal testing and control data, for example, data required for integrity checks; and type (2) signals generated in the circuitry by the heat from a heat source that is being scanning in the scanning zone. If the value is of type (1), this routine passes the digital value to whatever routine needs it. If the value is a temperature measurement (type (2)), this routine determines whether a train scan is in progress, and, if so, processes the temperature scan value.

A. Find Signal Type. This routine reads the channel number of the signal and sends the signal to the channel having the same number.

1. The Process Type 1 Signals (heat samples) Routine. If the channel number identifies a signal as a temperature reading sample from pyroelectric cell 14 (channel 1), the signal passes through channel 1, and invokes the "Train Pass Routine" (see FIG. 8C) to answer the "Is Train Passing" subroutine. If not train is passing, the software goes to the "Exit" routine, and returns to the Main Program. If the answer is yes, the software proceeds to the next routine, "Is a wheel in the scanning zone." If no, the software "Exits," returning to the Main Program. If yes, the software proceeds to the next routine.

a. The Is the Shutter Closed Routine. This routine determines, in conjunction with optical switch 64, 66, whether the temperature reading is a reference temperature reading (shutter closed) or a wheel component reading. If it is a reference temperature, the reference temperature subroutine iterates an algorithm to determine the lowest temperature sample measured during the shutter-closed state and uses this value for the latest reference temperature. If one temperature sample is not lower than the preceding sample, a setup subroutine, discussed below, is invoked. After the reference temperature subroutine is completed, the software exits to the Main Program.

b. The Subtraction, Filter and Smooth Routine. If the shutter is open, the "reference temperature subroutine" is skipped and the temperature signal is processed by this routine, which prepares a final output temperature signal for transmission from the serial port to the remote detector circuitry. This routine averages the temperature samples for each wheel component, and then generates the final output temperature signal by subtracting the reference temperature from the average temperature of each wheel component. This routine also ensures that a signal spike will not trigger a hot box warning by smoothing and filtering the signal.

c. The Setup Next Sample From Channel 1 Routine. This routine loads the analog to digital command register with the time (from a software timer) and the channel number of the next signal to be processed. This routine also loads the high speed output register of microcontroller 24 with instructions to perform the A/D conversion of the next sample after a predetermined period has expired. Then this routine "Exits," returning the software to the Main Program.

2. The Process Type 2 Signals Routine. This routine basically reads the channel number of an incoming signal and, if it is a type 2 signal, sends it to the software routine that needs that signal.

a. The DACBAK Signal Routine. If the signal is a DACBAK signal, this routine saves the values from the DACBAK Test Routine for use in integrity testing. When this routine is completed, it .Exits, returning the software to the Main Program.

b. The Twelve Volt Routine. This routine saves the values from the "Twelve Volt Test Routine" for use in integrity testing. When this routine is completed, it "Exits" returning the software to the Main Program.

c. The Five Volt Routine. This routine saves the values from the .Five Volt Test Routine for use in integrity testing. When this routine is completed, it .Exits, returning the software to the Main Program.

Having thus described the invention, what is claimed as new and desired to be secured by Letters Patent is:

1. A method of detecting an overheated component of a railroad train, comprising the steps of:

(a) at a trackside location, scanning a passing component with an infrared sensor during a scanning period;

(b) momentarily preventing any infrared radiation from said component from impinging on said sensor to thereby establish a reference temperature;

(c) repeating said step (b) at successive time spacings each shorter in duration than said period; and (d) comparing the response of said sensor when infrared is received to the response of the sensor at said time spacings.

2. The method as claimed in claim 1, wherein said step (c) is effected asynchronously with respect to said passing component.

3. The method as claimed in claim 1, further comprising the step of producing a heat signal in response to said sensor, and wherein said step (d) comprises comparing the amplitude of said heat signal between said time spacings with the amplitude of the heat signal at said time spacings.

4. The method as claimed in claim 3, wherein said step (c) includes providing a shutter for blocking infrared radiation from said component that would otherwise impinge on said sensor, and asynchonously closing said shutter at said time spacings to modulate the amplitude of said heat signal.

5. The method as claimed in claim 3, wherein said amplitude comparison in step (d) includes repeatedly sampling the amplitude of said heat signal between said time spacings and at said time spacings.

6. The method as claimed in claim 5, wherein said amplitude comparison in step (d) further includes selecting the lowest sampled amplitude at each of said time spacings as representing the reference temperature.

7. The method as claimed in claim 5, wherein said amplitude sampling is conducted at a higher rate at said time spacings.

8. In apparatus for detecting an overheated component of a railroad train:

a sensing unit adapted to be disposed at trackside and having an infrared sensing element and means for focusing incident infrared radiation from a passing component on said sensing element, a shutter movable between a normally open position and a closed position in which the shutter blocks radiation that would otherwise reach said sensing element via said focusing means so that the sensing element is subjected only to ambient heat, means responsive to said sensing element for producing a heat signal during a period in which the sensing element is scanning the passing component, drive means connected to said shutter for repeatedly momentarily closing the same at successive time spacings each shorter in duration than said period, and output means responsive to said heat signal for comparing its amplitude between said time spacings with its amplitude at said time spacings.

9. The combination as claimed in claim 8, wherein said drive means closes said shutter asychronously with respect to said passing component.

10. The combination as claimed in claim 8, wherein said shutter is rotatable through said positions thereof, and wherein said drive means rotates said shutter at a speed sufficient to effect said repeated closing of the shutter at said time spacings.

11. The combination as claimed in claim 8, wherein said output means includes means for repeatedly sampling the amplitude of said heat signal between said time spacings and at said time spacings.

12. The combination as claimed in claim 11, wherein said output means further includes means for selecting the lowest sampled amplitude at each of said time spacings as representing ambient temperature.

13. The combination as claimed in claim 11, wherein said sampling means effects said amplitude sampling at said time spacings at a higher rate than between said time spacings.

14. The combination as claimed in claim 8, wherein said infrared sensing element comprises a pyroelectric cell for producing an electrical current having a magnitude dependent upon the temperature of the source of incident radiation, and wherein said heat signal producing means includes amplifier means having an input directly connected to said cell and responsive to the current responsivity of the cell for providing said heat signal with an amplitude representing the intensity of the sensed radiation.

15. The combination as claimed in claim 14, wherein said amplifier means includes an active electrical element presenting said input and capable of amplifying the electrical current produced by said cell and providing an amplified output signal of substantially greater magnitude than the input current produced by the cell.

16. The combination as claimed in claim 15, wherein said active element has an output connection, and wherein said amplifier means further includes a high resistance feedback path from said output connection to said input.

17. The combination as claimed in claim 15, wherein said active element has an output connection, and wherein said amplifier means further includes a resistive T-network connected with said output connection and said input for providing a high resistance feedback path.

18. The combination as claimed in claim 17, wherein said active element is a monolithic electrometer operational amplifier.

* * * * *